US006775498B2

(12) United States Patent
Palumbo et al.

(10) Patent No.: US 6,775,498 B2
(45) Date of Patent: Aug. 10, 2004

(54) MULTI-FUNCTION CLEANER BLADE ASSEMBLY

(75) Inventors: Frank J. Palumbo, Nicholasville, KY (US); Tom E Stickler, Lexington, KY (US); David Clay Blaine, Lexington, KY (US); David Francis Carter, Mt. Sterling, KY (US); Matthew Lee Rogers, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/324,334

(22) Filed: Dec. 19, 2002

(65) Prior Publication Data

US 2003/0086725 A1 May 8, 2003

Related U.S. Application Data

(63) Continuation-in-part of application No. 09/789,065, filed on Feb. 20, 2001, now Pat. No. 6,522,851.

(51) Int. Cl.[7] ..... G03G 15/02; G03G 21/00

(52) U.S. Cl. ..... 399/176; 399/90; 399/350; 399/351

(58) Field of Search ..... 399/115, 223, 399/176, 90, 349, 123, 350, 351

(56) References Cited

U.S. PATENT DOCUMENTS 4,025,181 A 5/1977 Menon et al.
4,602,864 A 7/1986 Kimura et al.
5,019,868 A 5/1991 Kubert et al.
5,099,280 A 3/1992 Takemoto et al.
5,214,239 A 5/1993 Koga et al.
5,260,754 A 11/1993 Yano et al.
5,300,990 A 4/1994 Thompson
5,339,141 A 8/1994 Suzuki et al.
5,404,212 A 4/1995 Ditomaso
5,606,397 A 2/1997 Honda et al.
5,648,838 A 7/1997 Michlin et al.
5,878,306 A 3/1999 Michlin
6,203,962 B1 3/2001 Itami et al.
6,522,851 B2 * 2/2003 Stickler ..... 399/176
2003/0210927 A1 * 11/2003 Stickler et al. ..... 399/176

* cited by examiner

*Primary Examiner*—Susan Lee
(74) *Attorney, Agent, or Firm*—John A. Brady

(57) ABSTRACT

A bracket to mount a charge roller and a blade against a photoconductive drum within an image forming apparatus. Bracket may include a pair of guides that extend outward to receive the ends of the charge roller. A biasing device may be positioned to bias the charge roller against the photoconductive drum. The guides may include an opening sized to allow the charge roller to move and maintain contact with the photoconductive drum. A mounting surface may be positioned on the bracket for receiving adhesive to mount the blade. In one embodiment, the bracket is constructed of an electrically conductive material such that a charge introduced to the bracket is delivered to the charge roller.

20 Claims, 8 Drawing Sheets

MULTI-FUNCTION CLEANER BLADE ASSEMBLY

RELATED APPLICATIONS

This application is a continuation-in-part of the application Ser. No. 09/789,065, entitled "Multi-Function Cleaner Blade Assembly," and filed on Feb. 20, 2001, now U.S. Pat. No. 6,522,851 which is incorporated in its entirety herein by reference.

BACKGROUND OF THE INVENTION

Image forming devices including copiers, laser printers, facsimile machines, and the like, include a photoconductive drum (hereinafter referred to as a drum) having a rigid cylindrical surface that is coated along a defined length of its outer surface. The surface of the drum is charged to a uniform electrical potential and then selectively exposed to light in a pattern corresponding to an original image. Those areas of the photoconductive surface exposed to light are discharged thus forming a latent electrostatic image on the photoconductive surface. A developer material, such as toner, having an electrical charge such that the toner is attracted to the photoconductive surface is brought into contact with the drum's photoconductive surface. A recording sheet, such as a blank sheet of paper or a transfer belt, is then brought into contact with the photoconductive surface and the toner thereon is transferred to the recording sheet in the form of the latent electrostatic image. The recording sheet is then heated thereby permanently fusing the toner to it.

In preparation for the next image forming cycle, the photoconductive surface is optionally discharged and cleaned of residual toner. A cleaner blade is positioned adjacent to the drum for removing the residual toner that has not been transferred during the printing process. Removal of the residual toner is necessary prior to preparing the drum to receive a new image.

Conventional cleaner blades are manufactured by stamping and forming a bracket from a sheet metal stock, then molding or adhering a flexible elastomer member to the bracket. This assembly is attached to the printer in proximity to the drum such that the flexible member is deflected and pressed against the surface of the drum. There are often manufacturing difficulties in these conventional designs resulting from variations in the properties of the sheet such as the thickness and temper. These variations cause deviations from the desired form resulting in inconsistent removal of the residual toner across the length of the drum.

It is further desirable for the image forming apparatus to have the smallest dimensions possible. This is a key selling point to consumers who desire the small dimensions because the apparatus is easier to manipulate and move, and occupies a minimal amount of desk space in a workstation where available space is often at a premium. As a result of the smaller sizes, these internal elements of the image forming apparatus are located in a very compact space. Element designs used in physically larger printers may not be applicable to the smaller-sized apparatus because of the large dimensions. Thus, it is necessary to reduce the physical size of the elements.

SUMMARY OF THE INVENTION

The invention is directed to a device for mounting a charge roller against a photoconductive drum within an image forming apparatus. The device includes a bracket having a first guide and a second guide for mounting the charge roller. In one embodiment, the charge roller is movably positioned within the guides. In one embodiment, one or more biasing devices bias the charge roller against the photoconductive drum. Bearings may be positioned within the guides for mounting the charge roller axle. The bearings are movable within the guides.

In one embodiment, the bracket is constructed of an electrically conductive material. The bracket may be positioned within the image forming apparatus to contact an electrical connection. The electrical charge is then delivered to the bracket and to the charge roller. The bracket may include a connection that is sized and oriented to contact the electrical connection of the image forming apparatus.

In one embodiment, a cleaner blade is attached to the bracket. The cleaner blade extends along at least a portion of the photoconductive drum to remove residual toner.

DETAILED DESCRIPTION OF THE INVENTION

Figure 1:
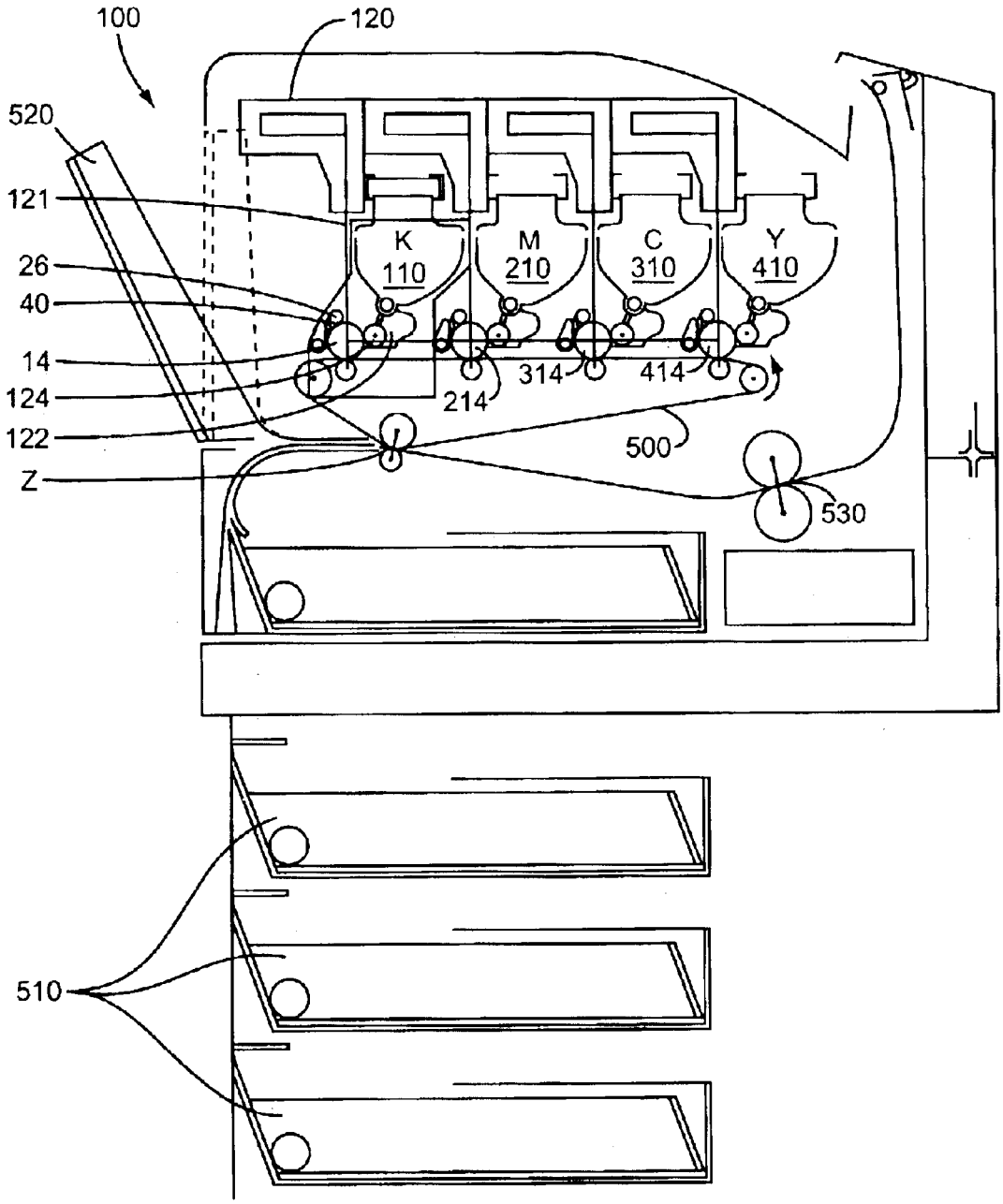
FIG. 1 is a side view illustrating a color laser printer constructed according to one embodiment of the present invention.

FIG. 1 illustrates the basic elements of an image forming device and is incorporated for an understanding of the overall electrophotographic image forming process. A color laser printer is illustrated as 100, however, one skilled in the art will understand that the present invention is applicable to other types of image forming devices. The image forming apparatus, generally designated 100, includes a plurality of similar toner cartridges 110, 210, 310, and 410. Each toner cartridge has similar construction but is distinguished by the toner color contained therein. In one embodiment, the device includes a black cartridge 110, a magenta cartridge 210, a cyan cartridge 310, and a yellow cartridge 410. The different color toners form individual images of a single color that are combined in layered fashion to create the final multicolored image. As the cartridges are respectively identical except for the toner color, the cartridge and elements for forming black images will be described, with the other color image forming units being omitted for simplification.

Drum 14 is generally cylindrically-shaped with one end having a means for coupling with the image forming device drive gears to provide for rotational movement. The drum 14 has a smooth surface for receiving an electrostatic charge over the surface as the drum 14 rotates past charge roller 26. The drum 14 continuously and uniformly rotates past a laser scanning assembly 120 that directs a laser beam 121 onto selected portions of the drum surface forming an electrostatic latent image representing the image to be printed. The drum 14 is rotated at a constant speed as the laser beam 121 is scanned across its length. This process continues as the entire image is formed on the drum surface.

After receiving the latent image, the drum 14 rotates past a toner area having a toner bin 122 for housing the toner and a developer roller 124 for uniformly transferring toner to the drum 14. The toner may also be charged to assist in the transfer to the paper. The toner is a fine powder usually composed of plastic granules that are attracted and cling to the electrostatic latent image formed on the drum surface by the laser scanning assembly 120.

The drum 14 next rotates past an adjacently-positioned intermediate transfer medium belt 500 (hereinafter, ITM belt) to which the toner is transferred from drum 14. As illustrated in FIG. 1, the ITM belt 500 is endless and extends around a series of rollers adjacent to the drums. The ITM belt 500 and the image on each drum 14, 214, 314, 414 are synchronized providing for the toner from each drum to precisely align on the ITM belt 500 during a single pass. By way of example as viewed in FIG. 1, the yellow (Y) toner will be placed on the ITM belt, followed by cyan (C), magenta (M), and black (K). After depositing the toner on the ITM belt 500, the drum 14 rotates through a cleaning area where residual toner is removed from the surface via a cleaning or scraper blade, hereinafter blade 40.

As the drums are being charged and gathering toner, a recording sheet, such as blank sheet of paper, is being routed to intercept the ITM belt 500. The paper may be placed in one of the lower trays 510, or introduced into the image forming device 100 through a side track tray 520. A series of rollers and/or belts transports the paper to point Z where the sheet contacts the ITM belt 500 and receives the toner. Preferably, voltage is applied to the roller that pushes the sheet of paper against the ITM belt 500 at point Z to pull the charged toner away from the belt 500 and onto the paper. The sheet and attached toner next travel through a fuser 530 having a pair of rollers and a heating element that heats and fuses the toner to the sheet. The paper with fused image is then transported out of the image forming apparatus.

Figure 2:
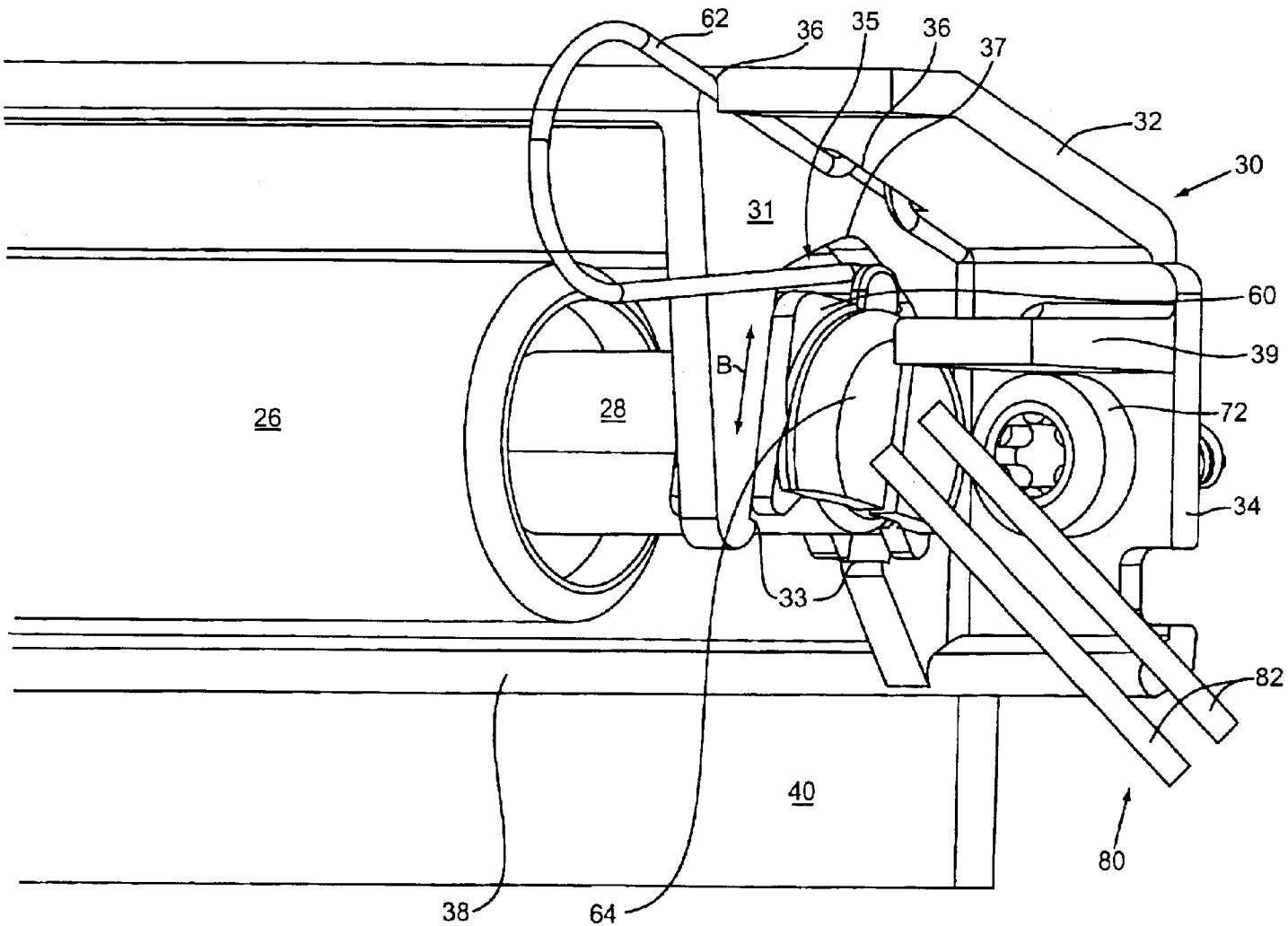
FIG. 2 is a partial perspective front view illustrating a first end of the bracket with a charge roller attached therein.

FIG. 2 illustrates a bracket 30 for mounting the charge roller 26 and cleaner blade 40 against the drum 14. The drum 14 has been omitted from FIG. 2 for clarity in illustrating the blade 40 and bracket 30 but is included in FIGS. 3 and 4. Guides 31 extend out to mount the charge roller 26 and a biasing device 62 biases the charge roller 26 against the drum 14. Blade 40 is attached to a mounting surface 50 (FIG. 3) on the bracket 30 and extends outward to contact the drum 14. Bracket 30 does not contact the drum 14, but is positioned such that charge roller 26 and blade 40 are maintained in contact with the drum 14. As the drum 14 rotates as indicated by arrow A in FIG. 3, blade 40 removes the residual toner that remains from the previous printing cycle. Drum 14 then rotates against charge roller 26 to be charged in preparation for the next printing cycle.

Bracket 30 may have a variety of orientations to mount and position the charge roller 26 and blade 40 against the drum 14. In the embodiment illustrated, bracket 30 comprises a unitary piece having first and second sections 32, 34 connected together along one edge. Sections 32, 34 may extend outward in a variety of angles including between about 90–130 degrees depending upon the dimensions and spacing of the charge roller 26 and blade 40 relative to the drum 14, and the size of the drum 14. In another embodiment, bracket 30 has a curved orientation that roughly corresponds to the curvature of the drum 14 to maintain the blade 40 and charge roller 26 seated on the drum surface. One skilled in the art will recognize that bracket 30 may have a variety of orientations and/or configurations.

An adhesive bonds the blade 40 to the bracket 30. A variety of adhesives may be used that provide an adequate bonding strength, and do not deteriorate the blade 40 or the bracket 30. Adhesive is applied across the length of the blade 40 to firmly bond the blade 40 to the bracket 30, and also form a seal to prevent toner from escaping between the blade 40 and bracket 30.

Figure 3:
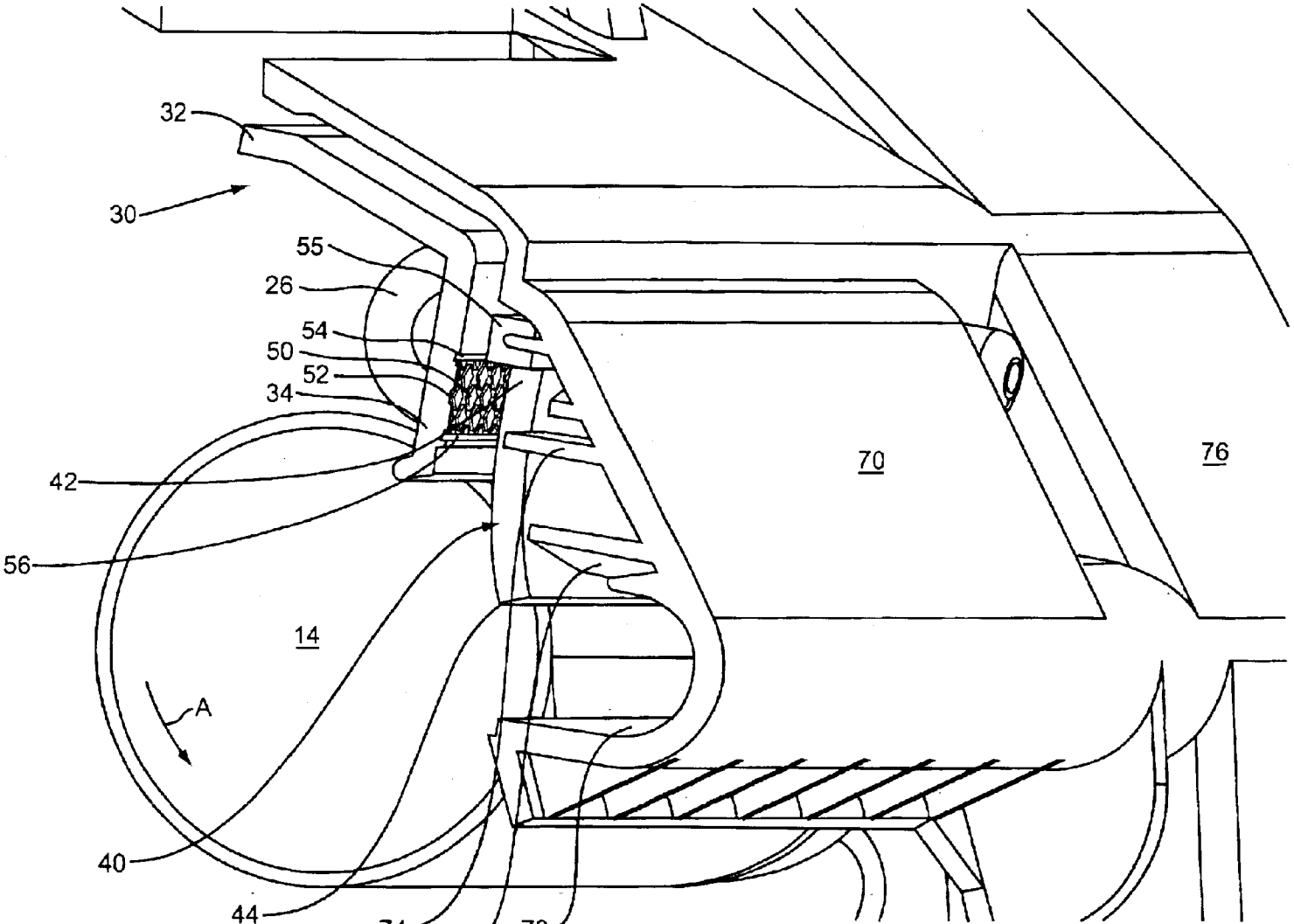
FIG. 3 is a partial perspective back view illustrating the bracket and charge roller positioned against a drum.

In one embodiment, bracket 30 includes a mounting surface 50 having a plurality of raised surfaces and channels or waffle pattern as illustrated in FIG. 3. Adhesive applied to the mounting surface 50 is distributed about the surfaces and excess adhesive flows into the channels to effectively bond the blade 40 to the bracket 30 and locate the blade 40 properly with respect to the bracket 30. In one embodiment, channels are recessed below the outer surface of the bracket 30 forming lateral edges 52 and a top edge 54. In one embodiment, a barrier 55, such as a sponge pad, is placed along the lateral and/or top edges of the blade 40 to further prevent toner escape. In another embodiment, mounting surface 50 is a substantially flat surface.

Figure 4:
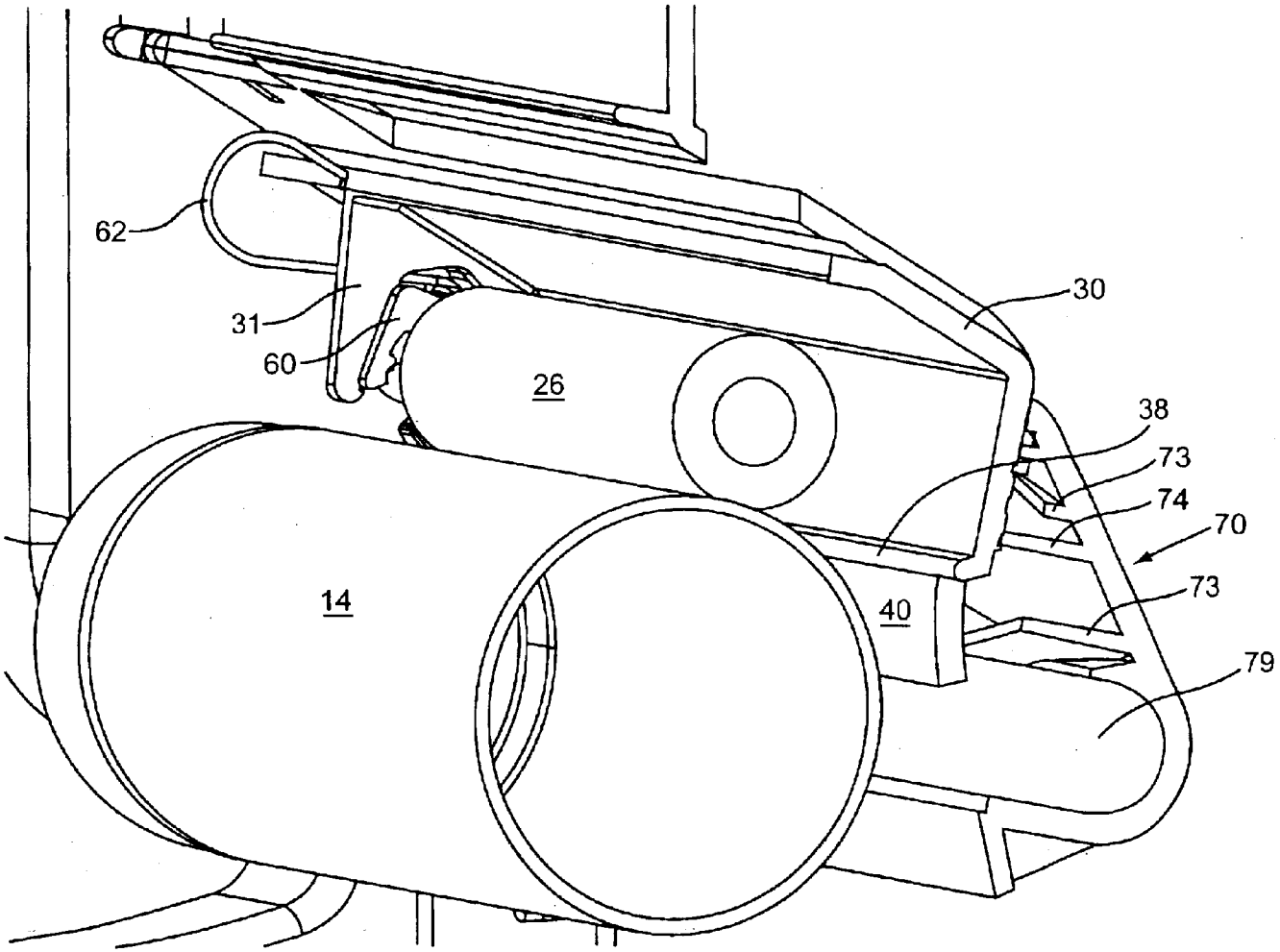
FIG. 4 is a partial perspective front view illustrating a second end of the bracket with a charge roller attached therein and mounted against the drum.
Figure 5:
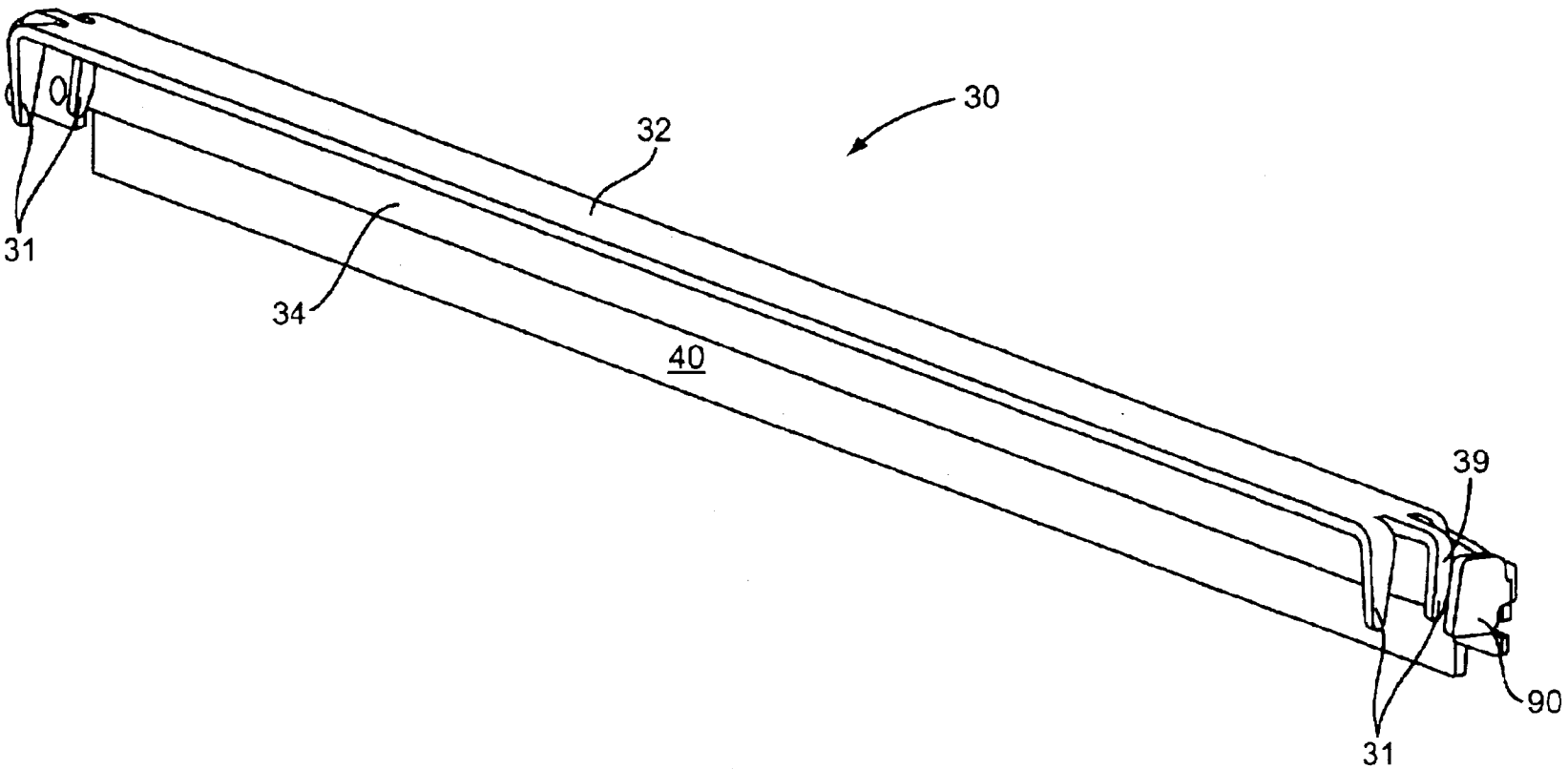
FIG. 5 is a perspective front view of one embodiment of the bracket constructed according to one embodiment of the present invention.
Figure 6:
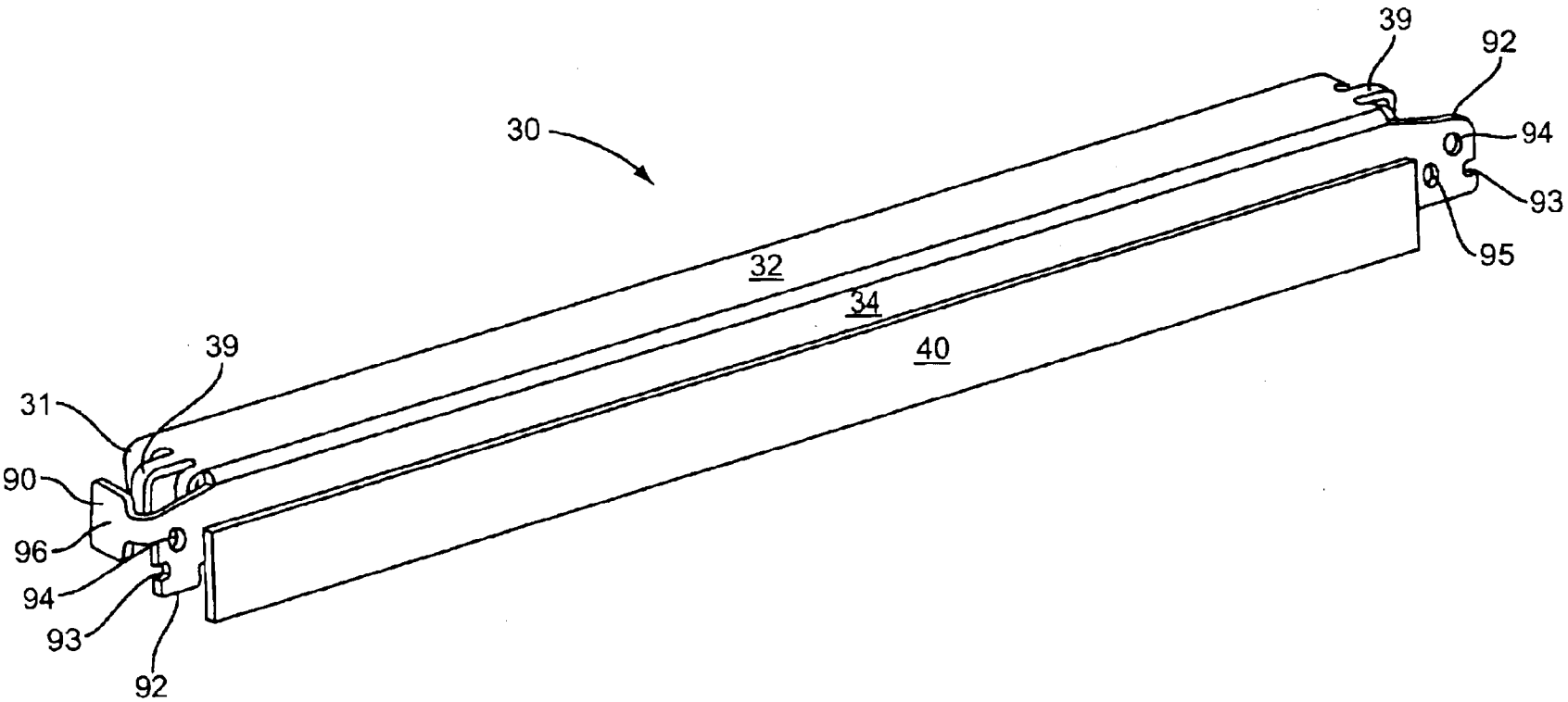
FIG. 6 is a perspective rear view of one embodiment of the bracket constructed according to one embodiment of the present invention.
Figure 7:
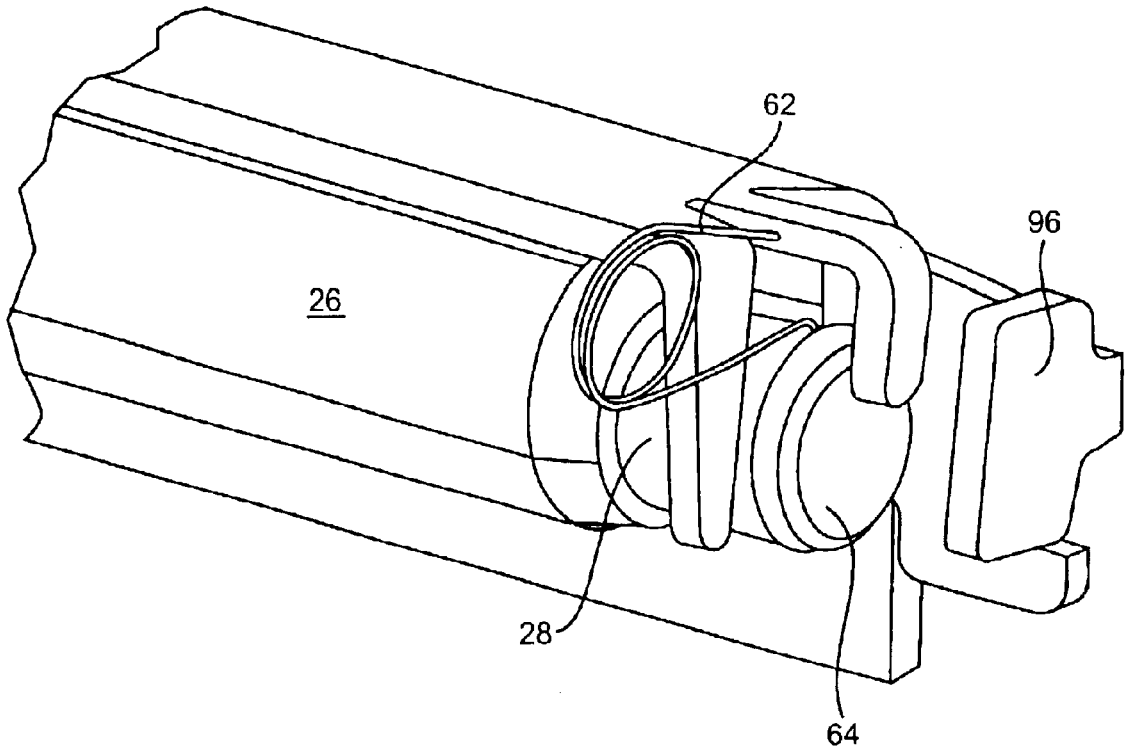
FIG. 7 is a perspective front view of one embodiment of the charge roll mounted within bracket constructed according to one embodiment of the present invention.

A bottom edge 56 of the mounting surface 50 establishes a flexural pivot of the blade 40 and affects the amount of force applied and therefore the cleaning properties. Blade 40 is constructed of an elastic material having a bowed configuration when placed against the drum 14 as illustrated in FIGS. 3 and 4. The resiliency of the blade 40 and the length of the blade 40 extending beyond the bottom edge 56 factor into the amount of force applied to the drum 14 by the blade 40.

Guides 31 extend outward from each end of the bracket 30 to position the charge roller 26 against the drum 14. Placement of the guides 31 at the bracket ends allows the charge roller axle 28 to be positioned within the guides 31 and the surface of the charge roller 26 to maintain contact across the surface of the drum 14. In one embodiment, guides 31 extend outward from the bracket 30 and comprise an opening 35 having an inner edge 37 and stops 33. A bearing 60 that extends around a portion of the charge roller axle 28 is positioned within the opening 35. Bearing 60 is sized to move between the inner edge 37 and stops 33 in the direction indicated by arrow B in FIG. 2. Bearing 60 may further include an end cap 64 that extends across at least a portion of the charge roller axle 28. Various other embodiments are also contemplated for mounting the charge roller 26 within the guides 31 such as the charge roller axle 28 mounting directly within the guides 31. In this embodiment, opening 35 is sized to directly contact the axle 28 and maintain the positioning of the charge roller 26.

A biasing device 62 is positioned between the bracket 30 and the charge roller 26 to bias the charge roller 26 against the drum 14. A variety of different mechanisms may be used as the biasing device 62 including mechanical devices such as a leaf or coil spring, or a material having resilient properties that bias the charge roller 26 against the drum 14. In the embodiment illustrated in FIG. 2, a spring 62 is positioned between the bracket 30 and the bearing 60.

Grooves 36 may be positioned within the bracket 30 to position the biasing device 62 and prevent it from moving along the length of the bracket 30. The force of the biasing device 62 is adequate for the charge roller surface to maintain contact with the drum surface across the entire length of the charge roller 26. Likewise, the force is adequate such that the rotation of the drum 14 is imparted to the charge roller 26. The force is not excessive such that the charge roller 26 binds or otherwise hinders the rotation of the drum 14.

In one embodiment, charge roller 26 is movably positioned within the bearing 60 and buttresses 39 extend outward from the bracket 30 on the outside edge of one or both guides 31 to limit the lateral movement of the charge roller 26. The ends of the charge roller axle 28 contact the buttress 39 to limit this movement. Buttresses 39 further provide protection for the charge roller 26 in the event the bracket 30 and/or image forming device 100 are dropped as they may prevent the charge roller 26 from falling out of the guides 31 and becoming damaged.

In one embodiment, electrical connections 80 contact the charge roller 26 to charge the charge roller 26. In one embodiment, electrical connections 80 comprise contact fingers 82 that contact one end of the charge roller 26. The contact fingers 82 may apply an axial force to the charge roller 26 that pushes it against the opposite buttress 39 and maintains the electrical contact. In one embodiment, end cap 64 is constructed of a conductive plastic material. The contact fingers 82 contact the end cap 64, which in turn transfers the charge to the charge roller 26. This embodiment minimizes noise that may be caused by the contact fingers 82 directly contacting the rotating charge roller axle 28.

Blade 40 extends from the bracket 30 to contact the drum 14 and remove residual toner remaining from the previous printing cycle. Blade 40 has a generally rectangular configuration that extends beyond the mounting surface 50. Blade 40 is constructed of a resilient material, such as urethane, that can be bent to apply additional force against the surface of the drum 14.

Charge roller 26 applies a uniform electrical charge to the drum 14 in preparation for receiving the image via the laser scanning assembly 120. Charge roller 26 comprises an outer surface that contacts the drum 14 and an axle 28 about which the roller rotates. The charge roller 26 is substantially cylindrical, and may have a slightly larger circumference about a mid-point to ensure contact is maintained across the entire length of the drum 14.

In one embodiment, bracket 30 is constructed via a molding process that allows for easier inclusion of elements such as guides 31 and the reinforcing ribs 38 and provides for reduced cost and increased dimensional accuracy. Reinforcing ribs 38 may be incorporated to prevent the bracket 30 from deflecting due to the force of applying the blade 40 against the drum 14. Additionally, bracket 30 may be contoured to compensate for the deflection thus resulting in a more uniform pressure of the blade working edge 44 against the drum 14. In one embodiment, bracket 30 is constructed of a reinforced thermoplastic polymer, although one skilled in the art will understand that the bracket 30 can be molded from a variety of materials.

A toner removal tray 70 may be positioned adjacent to the cleaner blade 40 as illustrated in FIGS. 3 and 4. Tray 70 includes a channel 79 to capture the residual toner that is removed from the drum 14. Channel 79 may be sized to hold the toner, or may include an auger (not illustrated) or other like device for directing the toner along the channel 79 for storage in a reservoir 76. Supports 74 may further extend from the tray 70 to assist in maintaining the blade 40 positioned against the drum 14. Additional stiffening ribs 73 prevent deflection of the toner removal tray 70.

The electrical connection for the charge roller 26 may be accomplished in other manners. In one embodiment, bracket 30 is constructed of an electrically conductive material. The bracket 30 is positioned within the image forming apparatus to contact the electrical connection 80. In one embodiment, the bracket 30 is constructed of steel. In another embodiment, the bracket 30 is constructed of nickel-plated steel. In one embodiment, the bracket 30 is constructed of a conductive plastic.

In use, the bracket 30 is positioned in the image forming apparatus such that the face 96 of the connection 90 contacts the finger or fingers 82 of the electrical connection 80. A charge is introduced into the bracket 30 which is delivered through the bearing 60 or directly to the charge roller 26.

Figure 8:
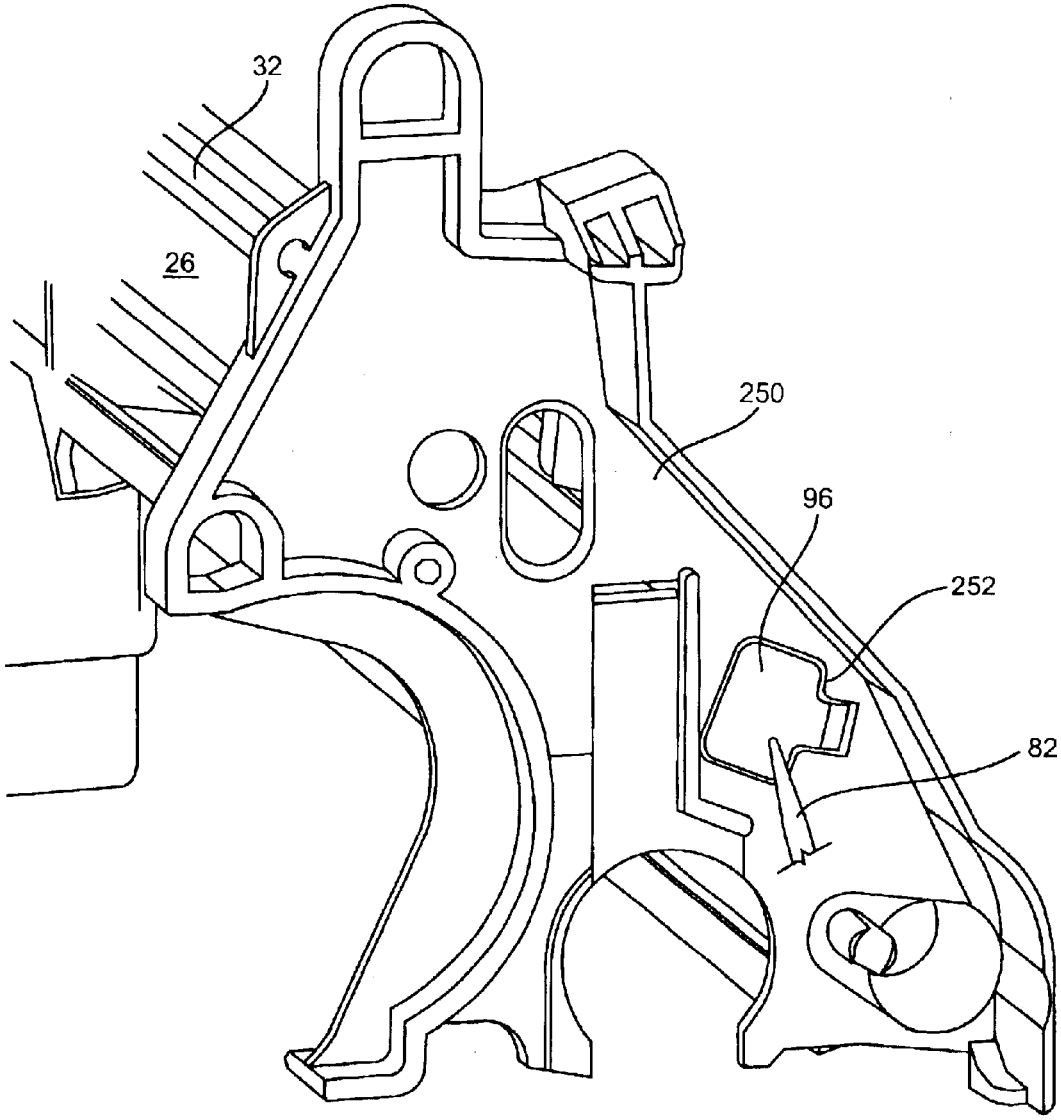
FIG. 8 is a side view of a cleaner housing having an opening for positioning the bracket for contacting an electrical connection.

FIG. 8 is a side view of one embodiment of a cleaner housing 250 within the image forming apparatus. The cleaner housing 250 includes an opening 252 where the electrical connection 80 is located. In the embodiment illustrated in FIG. 8, a finger 82 is positioned adjacent to the opening 252. The bracket 30 is positioned within the cleaner housing 250 with the connection 90 fitting within the opening 252 and contacting the finger 82 such that a charge is delivered to the bracket 30. In one embodiment, the opening 252 is approximately the same size as the face 96.

Guides 31 extending from the bracket 30 are sized to maintain a bearing 60. Bearing 60 is further constructed of a conductive material such that a charge delivered through the bracket 30 moves through the bearing 60 and into the charge roller 26. In one embodiment, bearing 60 is constructed of conductive plastic. One or more biasing devices 62 are connected between the bracket 30 and the bearings 60 to bias the charge roller against the photoconductive drum 14. In one embodiment, the axle 28 of the charge roller 26 is held directly within the guides 31 without a bearing 60. The charge introduced into the bracket 30 is delivered directly to the charge roller 26.

In use, the bracket 30 is positioned in the image forming apparatus such that the face 96 of the connection 90 contacts the finger or fingers 82 of the electrical connection 80. A charge is introduced into the bracket 30 which is delivered through the bearing 30 or directly to the charge roller 26.

In one embodiment, the guides 31 contact the conductive end cap 64 mounted on the end of the charge roll axle 28. The electrical charge is then directed from the bracket 30, to the end cap 64, and to the charge roller 26.

In one embodiment, bracket 30 includes a support 92 extending from each end. Notches 93 on one or both supports 92 aligns with datums for positioning the bracket 30 within the image forming apparatus. Apertures 94 are sized to receive fasteners 72 for connecting the bracket 30 to the image forming body.

The present invention may be carried out in other specific ways than those herein set forth without departing from the scope and essential characteristics of the invention. The embodiment illustrated in FIG. 1 comprises separate cartridges for each different color. The present invention is not limited to this type of printer, but is also applicable in various other printer embodiments that feature a photoconductive drum. Additionally, bracket 30 may be positioned within a cartridge that is removably positioned within the image forming device 100, or may be permanently mounted within the device. Fasteners 72 that extend through apertures in the bracket 30 are used for attachment. The present embodiments are, therefore, to be considered in all respects as illustrative and not restrictive, and all changes coming within the meaning and equivalency range of the appended claims are intended to be embraced therein.

What is claimed is:

1. A device for cleaning and charging a photoconductive drum within an image forming apparatus, the device comprising:

a. a bracket comprising first and second guides and a mounting surface, the first guide being positioned adjacent to a first end of the bracket and the second guide being positioned adjacent to a second end of the bracket;

b. a cleaner blade attached to the mounting surface and extending outward therefrom to contact the photoconductive drum;

c. a charge roller mounted to the first and second guides and being positioned against the photoconductive drum; and d. a biasing device to bias the charge roller against the photoconductive drum.

2. The device of claim 1, further comprising a bearing positioned within each of the guides to receive the charge roller.

3. The device of claim 1, wherein the biasing device is mounted on the bracket to bias the charge roller against the photoconductive drum.

4. The device of claim 2, wherein the biasing device is operatively mounted to the bearing to bias the charge roller against the photoconductive drum.

5. The device of claim 4, wherein the bracket comprises first and second sections positioned at an angle between them within the range of 90–130 degrees.

6. The device of claim 1, wherein the bracket is constructed of an electrically conductive material.

7. The device of claim 6, further comprising a connection integrally connected to the bracket and extending outward therefrom to contact an electrical connection within image forming apparatus.

8. A device for charging a photoconductive member within an image forming apparatus comprising:

a. a bracket having first and second guides and a connection positioned to contact an electrical member within the image forming apparatus;

b. a charge roller mounted to the first and second guides; and c. a biasing device to bias the charge roller against the photoconductive member;

d. wherein the bracket is constructed of an electrically conductive material and a charge introduced through the electrical member is transferred through the bracket to the charge roller.

9. The device of claim 8, further comprising a bearing positioned within the first guide to receive the charge roller, the bearing being constructed of a material that conducts electricity.

10. The device of claim 9, wherein the biasing device is positioned between the bracket and the bearing.

11. The device of claim 9, wherein the connection is positioned at a first end of the bracket and includes a face which contacts the electrical member within the image forming apparatus.

12. A device for cleaning and charging a photoconductive drum, the device comprising:

a. an elongated bracket extending along at least a length of the photoconductive drum;

b. first and second guides extending outward from a first side of the bracket, the first guide being positioned adjacent to a first end of the bracket and the second guide being positioned adjacent to a second end of the bracket;

c. a bearing movably positioned within each of the guides;

d. a charge roller mounted within the bearings;

e. a biasing device operatively connected to at least one of the bearings and the bracket, the biasing device applying a force to maintain the charge roller positioned against the photoconductive drum; and f. a blade connected to the bracket and extending outward therefrom to contact the photoconductive drum.

13. The device of claim 12, further comprising an electrical connection extending outward from the bracket and being aligned substantially perpendicular with an axis of the charge roller.

14. The device of claim 12, wherein the bracket is constructed of an electrically conductive material.

15. An image forming device comprising:

a. a photoconductive drum;

b. a charge roller to apply a charge to the photoconductive drum;

c. a laser assembly to create an image on the photoconductive drum;

d. a developer roller to transfer toner to the photoconductive drum;

e. a cleaner blade to remove the toner from the photoconductive drum; and f. a bracket to mount the cleaner blade and the charge roller against the photoconductive drum, the bracket comprising first and second guides each comprising an opening adapted to receive the charge roller and a mounting surf hce adapted to receive the cleaner blade; and g. a biasing device positioned between the bracket and the charge roller to bias the charge roller against the photoconductive drum.

16. The device of claim 15, wherein the bracket is constructed of an electrically conductive material.

17. The device of claim 15, further comprising a cleaner housing for positioning the bracket, the cleaner housing comprising an opening adjacent to the bracket.

18. The device of claim 17, further comprising an electrical connection within the image forming device and positioned adjacent to the opening, the electrical connection contacting the bracket through the opening to supply an electrical charge to the bracket.

19. The device of claim 15, further comprising at least one buttress extending outward from the bracket and being adjacent to one of the guides to limit lateral movement of the charge roller relative to the bracket.

20. The device of claim 15, wherein the biasing device applies a farce to press the charge roller against the drum, the force being adequate such that rotation of the drum causes rotation of the charge roller.

* * * * *